US011565390B1

(12) United States Patent
Brown

(10) Patent No.: US 11,565,390 B1
(45) Date of Patent: Jan. 31, 2023

(54) SPECIALIZED PRYING TOOL SET AND METHOD OF USE

(71) Applicant: John Brown, Fort Lauderdale, FL (US)

(72) Inventor: John Brown, Fort Lauderdale, FL (US)

( * ) Notice: Subject to any disclaimer, the term of this patent is extended or adjusted under 35 U.S.C. 154(b) by 0 days.

(21) Appl. No.: 17/092,342

(22) Filed: Nov. 9, 2020

(51) Int. Cl.
*B25B 27/00* (2006.01)
*B25B 27/14* (2006.01)

(52) U.S. Cl.
CPC ..... *B25B 27/0092* (2013.01); *B25B 27/0035* (2013.01); *B25B 27/14* (2013.01)

(58) Field of Classification Search
CPC . B25B 27/00; B25B 27/0071; B25B 27/0094; B25B 28/00; B25B 31/00; B23P 11/00
See application file for complete search history.

(56) References Cited

U.S. PATENT DOCUMENTS 2,224,892 A * 12/1940 Allen ..... B25F 1/04 7/170
4,100,637 A * 7/1978 Grieser, Sr. ..... B25F 1/00 279/147
7,020,923 B1 * 4/2006 Jangula ..... B25B 13/56 7/158
7,111,533 B1 * 9/2006 Ran ..... B25G 1/085 7/165
2007/0261174 A1 * 11/2007 Barker ..... B26B 5/002 7/160
2015/0113738 A1 * 4/2015 Wells ..... A62B 3/005 7/166

OTHER PUBLICATIONS

Kitbest Removal Tool 12Pcs Auto Panel Removal Tool Car Interior Trim Kit Fastener Rivet Remover Plastic Pry Tool for Automotive Radio Stereo Dash Upholstery Toolkit (Year: May 2019).*

* cited by examiner

*Primary Examiner* — Lee D Wilson
(74) *Attorney, Agent, or Firm* — Frank L. Kubler

(57) ABSTRACT

A set of tools for prying and removing virtually all vehicle trim and upholstery items includes a sharp curve trim removal tool having an elongate cylindrical rod with a scalloped, scoop-shaped distal end and a pocket clip, a defined fulcrum trim and upholstery removal tool having a flat bar having a rectilinear handle segment extending from the tool proximal end to a middle segment, and a curved tool distal end defining a rounded corner functioning as an acute upturned fulcrum curve along a tool lower surface, giving the user added mechanical advantage. The bar tapers to a sharp edge at the distal end. The set further includes a clip removal tool which is the same as the trim and upholstery removal tool except that it additionally includes a central notch in the sharp edge at the distal end for clip engagement.

7 Claims, 13 Drawing Sheets

SPECIALIZED PRYING TOOL SET AND METHOD OF USE

BACKGROUND OF THE INVENTION

1. Field of the Invention

The present invention relates generally to the field of tools. More specifically the present invention relates to a set of tools of progressively increasing leverage for specialized prying functions to separate various items from structures to which they are mounted, including a sharp curve trim removal tool, a defined fulcrum trim and upholstery removal tool, a defined fulcrum clip removal tool, and a progressive curve trim and upholstery removal tool, all formed of a suitable non-metallic material and specifically DELRIN™. Each tool has a proximal end for gripping and a distal end for engaging an item to be pried.

The sharp curve trim removal tool, also referred to as the POCKET PRY™, is an elongate cylindrical rod having a scalloped, scoop-shaped distal end and preferably a rounded proximal end. The circumferential side surface of the rod preferably has a grip enhancing texture such as the illustrated parallel grooves. A pocket clip similar to those fitted onto pencils preferably is fitted over the rod near the proximal end. The defined fulcrum trim and upholstery removal tool, also referred to as the PUSHER™ tool, includes a flat bar of rectangular cross-section. The bar has a rectilinear handle segment extending from the tool proximal end and middle segment, and an arched distal end forming an acute upturned fulcrum curve along a tool lower surface. The bar has a flat upper engaging surface, the fulcrum curve tapering to a sharp edge and generally define a wedge shape. The linear handle segment preferably has grip enhancing texturing, such as the illustrated lateral parallel grooves. The defined fulcrum point clip removal tool, also referred to as the POPPER™ tool, has the same structure as the defined fulcrum point trim and upholstery removal tool, but a central notch is provided in the edge at the distal end. The notch permits engagement and popping of a push clip. The progressive curve trim and upholstery removal tool, also referred to as the PERSUADER™ tool, includes an elongate member shaped as a wedge, where the wedge wider end is the tool proximal end for gripping and the wedge narrow end converging to a sharp edge is the tool distal end for insertion under or behind an item to be removed. The wedge-shaped elongate member has a progressive curve along its length, so that it has a wedge convex face and a wedge concave face. The progressive curve provides an infinite number of potential fulcrum points along the full length of the elongate member, permitting the tool to be pivoted as a lever at any point along its convex face, giving the user added mechanical advantage for more effective prying. The wedge shape also permits the tool to be pushed between an item and surface to be separated. These tools have been designed with smooth finishes which create less friction while fitting between tightly fitting parts.

A method of using any of the tools of the set of tools, including the steps of inserting the sharp distal end between an edge of an item to be removed and the surface to which it is secured, and pivoting the given tool at a point on a curved portion of its side, which acts as a fulcrum to provide a mechanical advantage for item removal.

2. Description of the Prior Art

There have long been various types of tools that have been used for prying. For removing trim, vents and other items from the interiors of vehicles a wide variety of prying tools have been needed. An example of such specialized prying tools is the eleven tools produced and sold by MATCO TOOLS™, in packages marked FMR5 and FMR6, and marked as being a "fastener and molding removal set". The need for so many tools makes tool selection at each stage of a job time consuming, requires more tool box space and makes a full set relatively expensive. What is needed is a full set of prying tools made up of fewer tools which are more versatile than those of the prior art.

It is thus an object of the present invention to provide a set of tools including a relatively small number of tools that can perform virtually all vent, trim, clip and upholstery prying functions.

It is another object of the present invention to provide such a set of tools of progressively increasing leverage.

It is finally an object of the present invention to provide such a set of tools which are durable, reliable and inexpensive to manufacture.

SUMMARY OF THE INVENTION

The present invention accomplishes the above-stated objectives, as well as others, as may be determined by a fair reading and interpretation of the entire specification.

A set of tools of progressively increasing leverage is provided for specialized prying functions to separate various items from structures to which they are mounted, such as in a vehicle dashboard or interior panel. including a sharp curve trim removal tool, a defined fulcrum trim and upholstery removal tool, a defined fulcrum clip removal tool, and a progressive curve trim and upholstery removal tool, all formed of a suitable non-metallic material and specifically acetal resin. Each tool has a proximal end for gripping and a distal end for engaging an item to be pried.

The sharp curve trim removal tool is an elongate cylindrical rod having a scalloped, scoop-shaped distal end and preferably a rounded proximal end. The circumferential side surface of the rod preferably has a grip enhancing texture such as the illustrated parallel grooves, and includes a pocket clip. The defined fulcrum trim and upholstery removal tool includes a flat bar of rectangular cross-section. The bar has a rectilinear handle segment extending from the tool proximal end and middle segment, and an arched distal end forming an acute upturned fulcrum curve along a tool lower surface. The bar has a flat upper engaging surface, the fulcrum curve tapering to a sharp edge and generally define a wedge shape. The linear handle segment preferably has grip enhancing texturing, such as the illustrated lateral parallel grooves. The defined fulcrum point clip removal tool has the same structure as the defined fulcrum point trim and upholstery removal tool, but a central notch is provided in the edge at the distal end. The notch permits engagement and popping of a push clip. The progressive curve trim and upholstery removal tool includes an elongate member shaped as a wedge, where the wedge wider end is the tool proximal end for gripping and the wedge narrow end converging to a sharp edge is the tool distal end for insertion under or behind an item to be removed. The wedge-shaped elongate member has a progressive curve along its length, so that it has a wedge convex face and a wedge concave face.

A method of using any of the tools of the set of tools includes the steps of inserting the sharp distal end between an edge of an item to be removed and the surface to which it is secured, and pivoting the given tool at a point on a curved portion of its side, which acts as a fulcrum to provide a mechanical advantage for item removal.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 2:
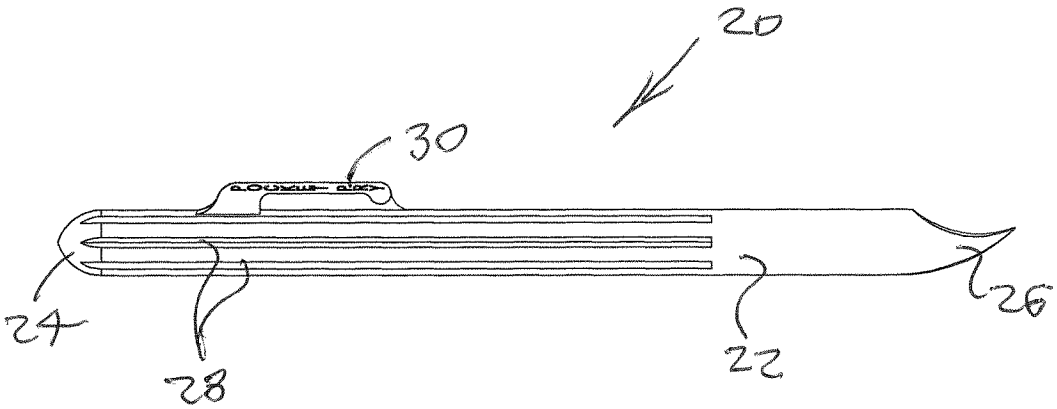
FIG. 2 is a side plan view of the pocket pry tool of FIG. 1.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 1:
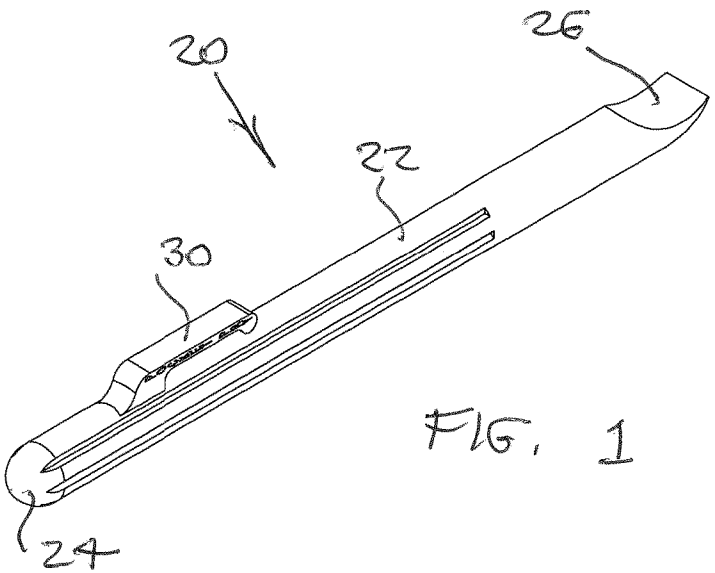
FIG. 1 is a perspective view of the pocket pry tool showing the preferred distal end scoop configuration and pocket clip.
Figure 3:
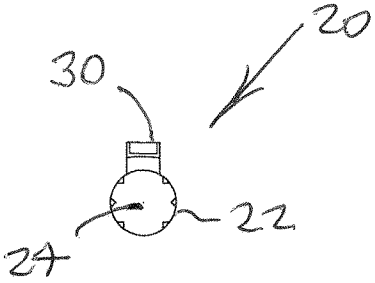
FIG. 3 is a proximal end plan view of the pocket pry tool of FIG. 1.
Figure 4:
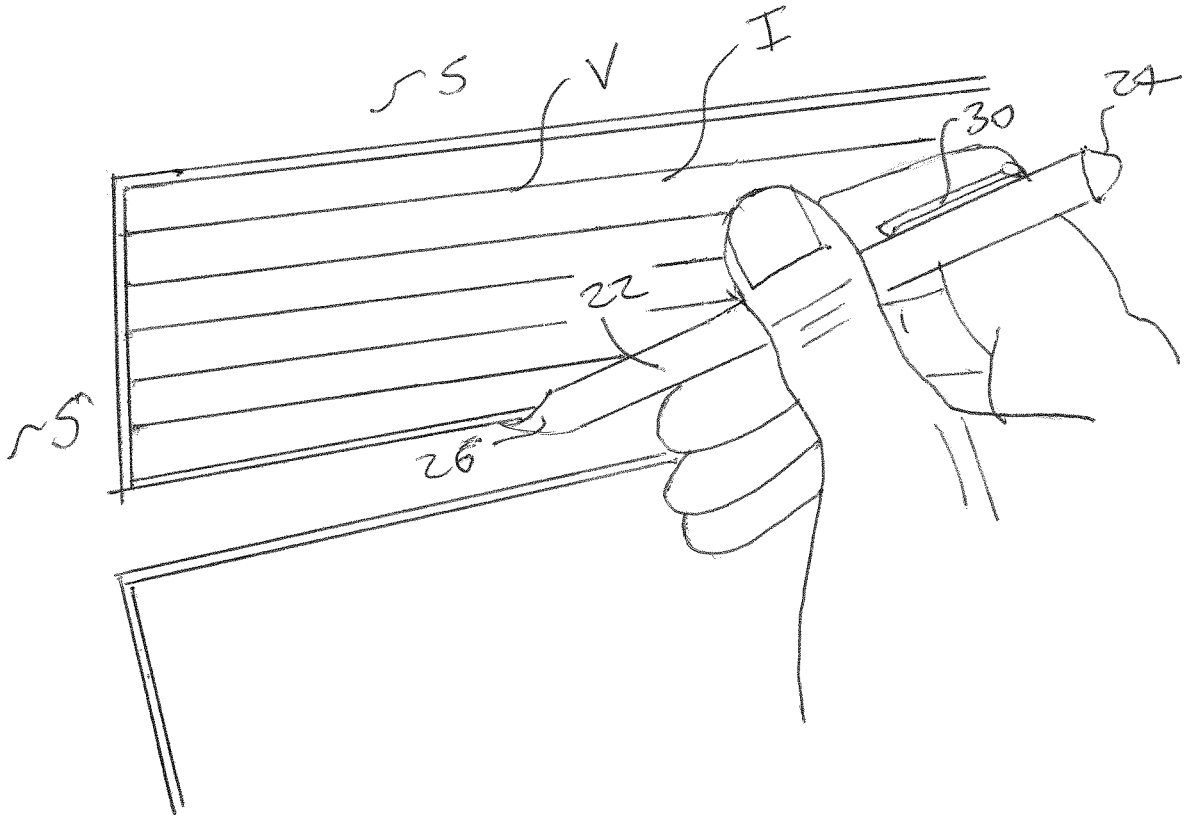
FIG. 4 is perspective view of the pocket pry tool of FIG. 1, beginning to pry a vent from an opening in a dashboard mounting surface.
Figure 5:
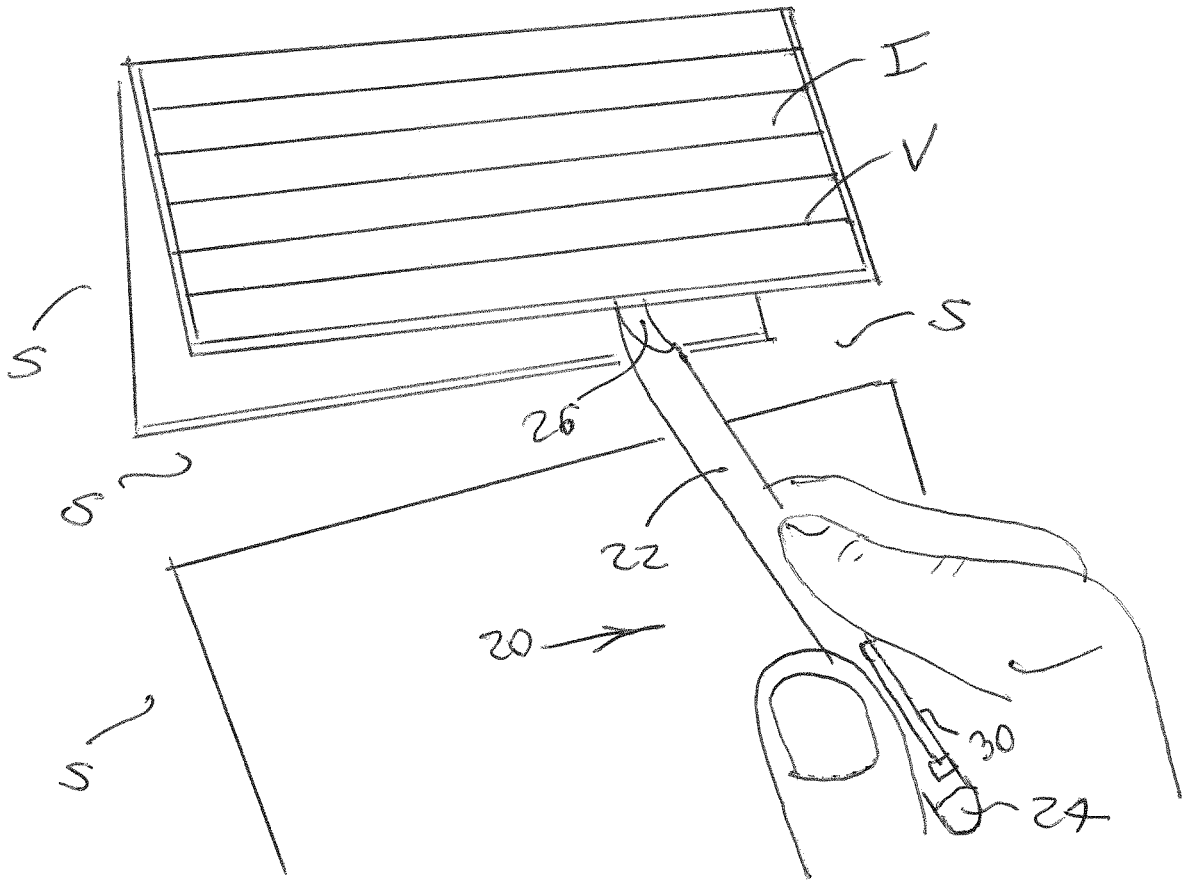
FIG. 5 is a view as in FIG. 4 showing the vent partly pried out of its mounting hole.
Figure 7:
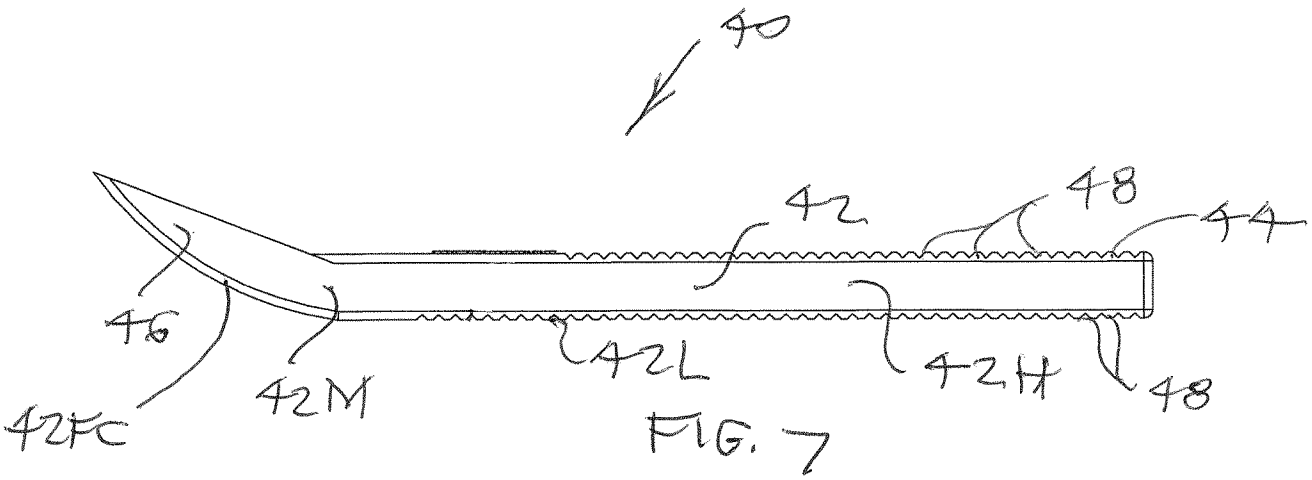
FIG. 7 is a side plan view of the pusher tool of FIG. 6.
Figure 6:
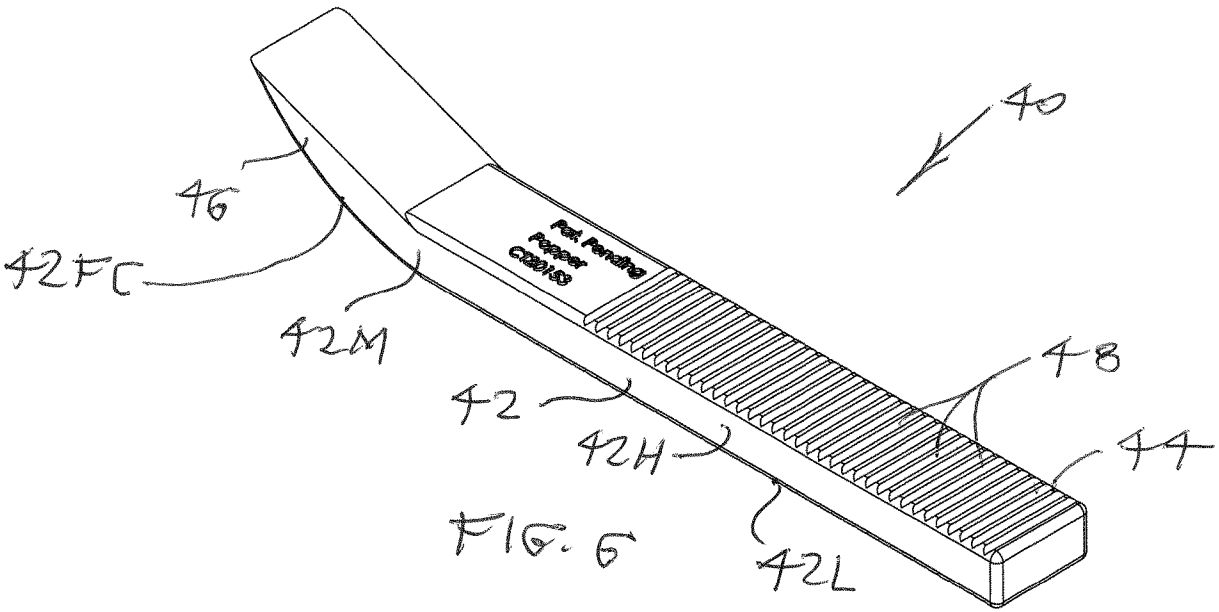
FIG. 6 is a perspective view of the pusher tool, showing its preferred fulcrum curve.
Figure 8:
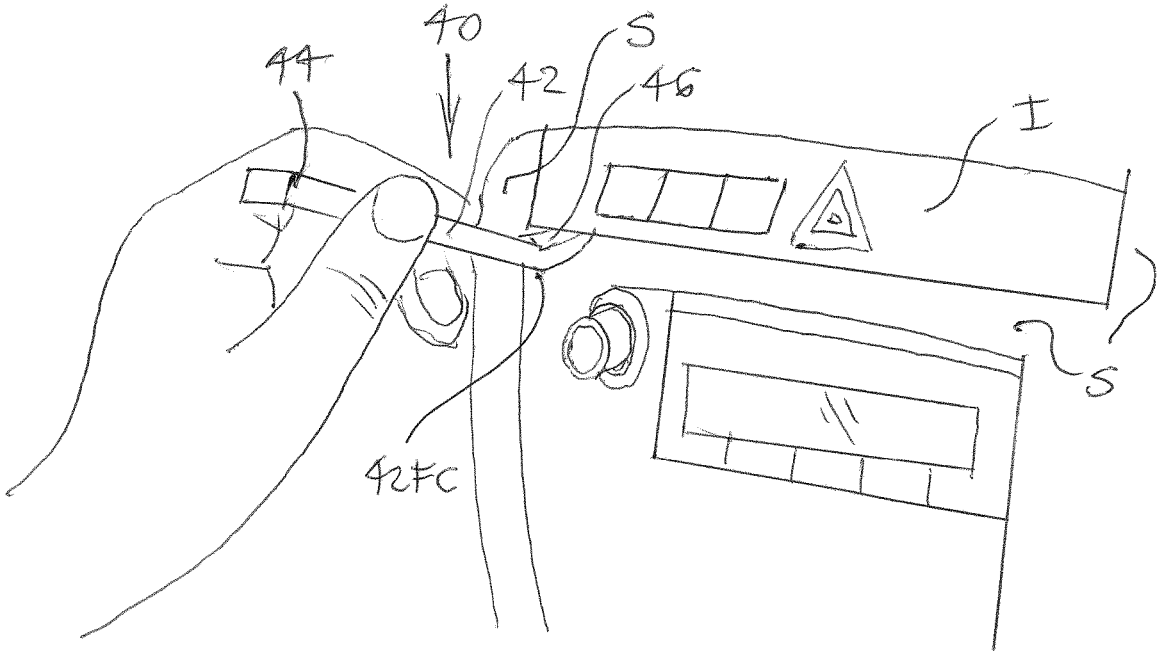
FIG. 8 is a perspective view of the pusher tool of FIG. 6, beginning to pry a trim item from a dashboard mounting surface.
Figure 9:
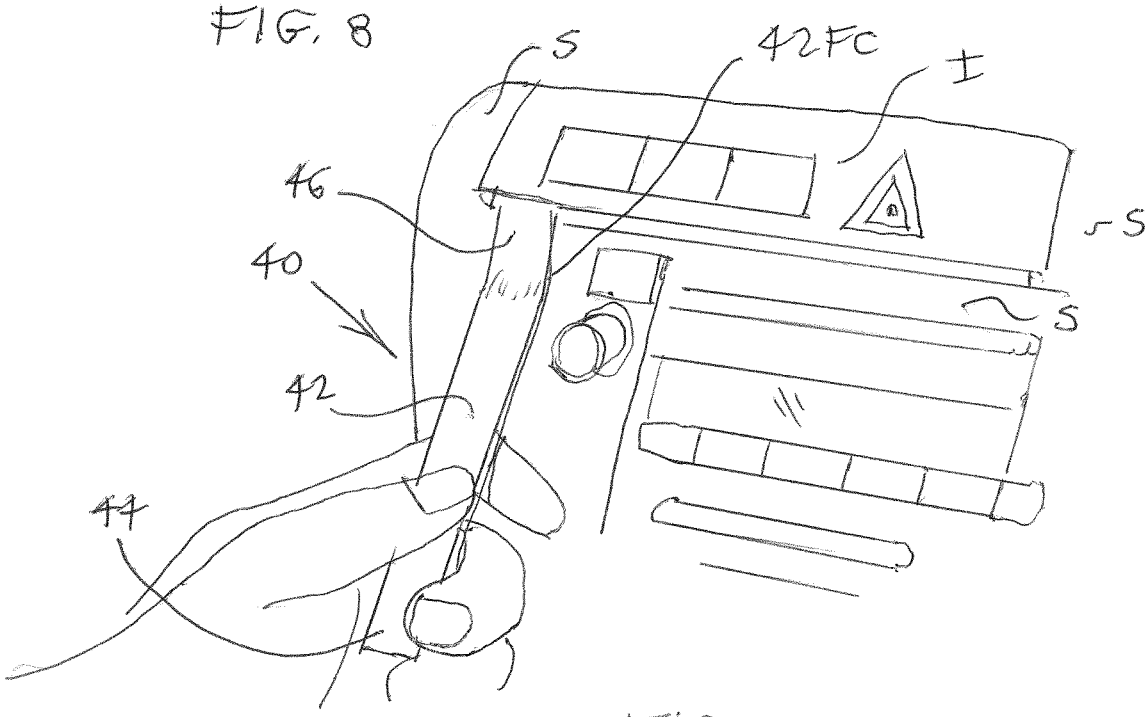
FIG. 9 is a view as in FIG. 8, showing the trim item partly pried off its mounting surface.
Figure 11:
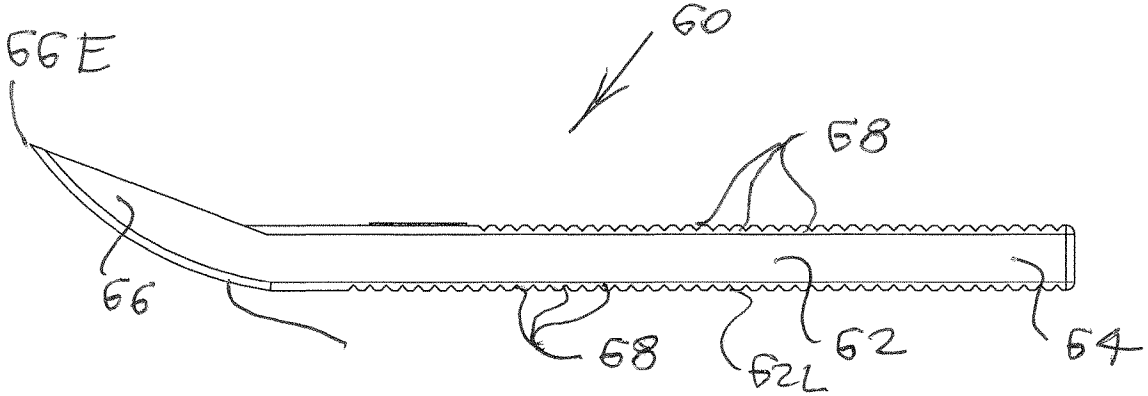
FIG. 11 is a side plan view of the popper tool of FIG. 10.
Figure 10:
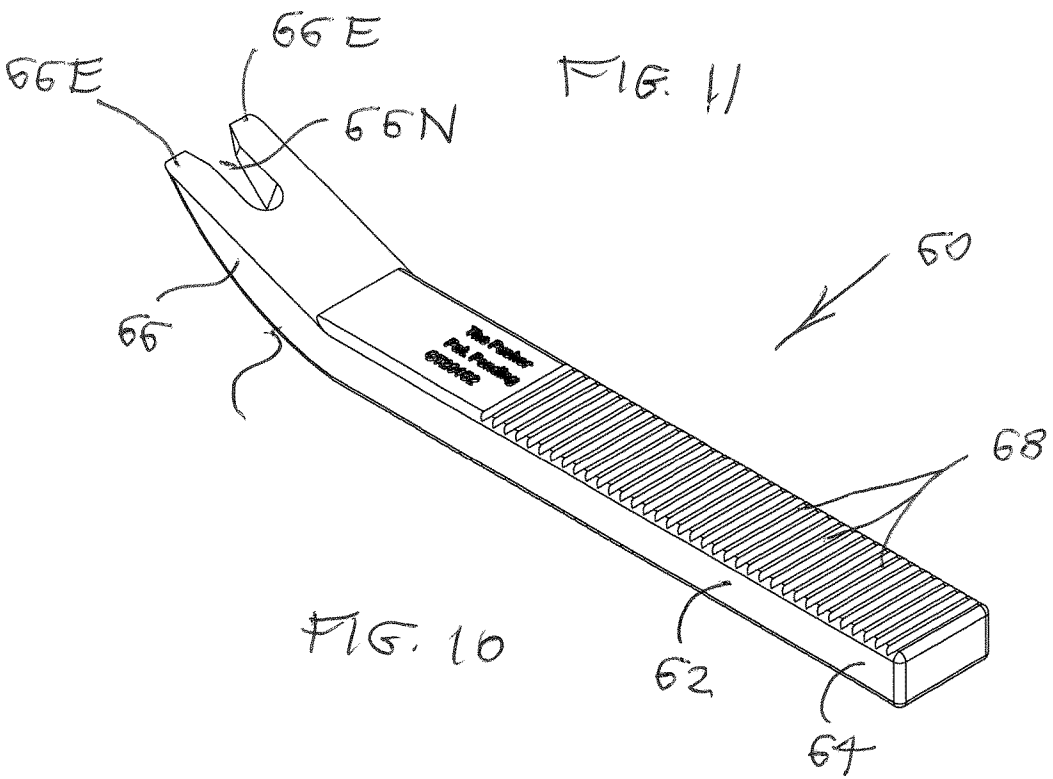
FIG. 10 is a perspective view of the popper tool, showing its preferred fulcrum curve.
Figure 12:
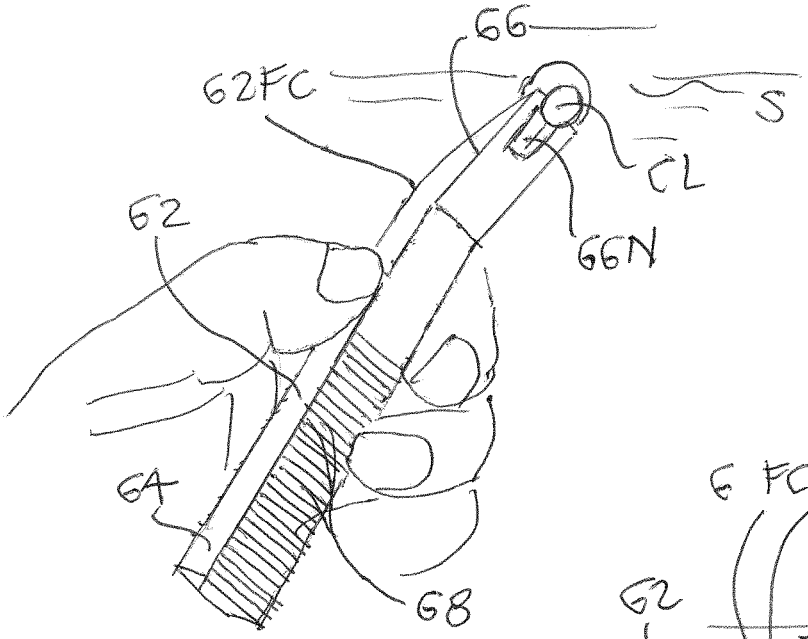
FIG. 12 is a perspective view of the popper tool of FIG. 10, beginning to pry the clip connecting structure of a push clip from a mounting surface.
Figure 13:
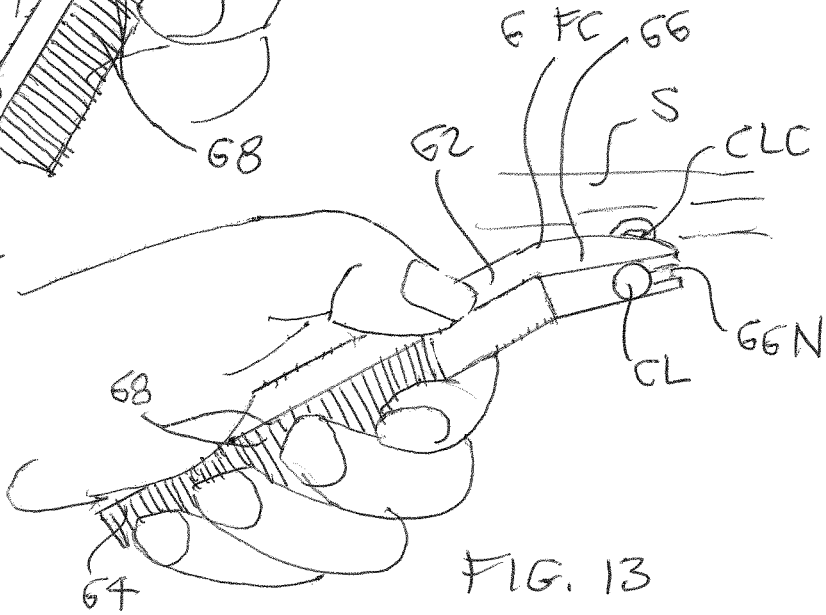
FIG. 13 is a view as in FIG. 12, showing the clip partly pried out its mounting surface.
Figure 14:
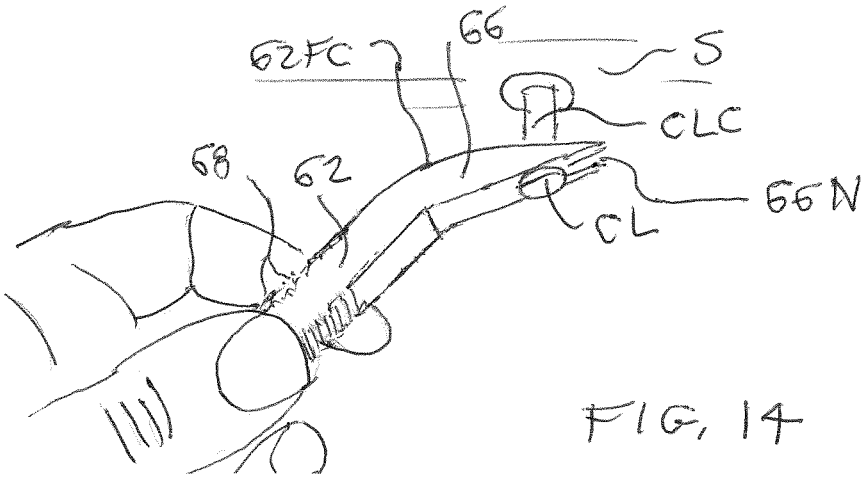
FIG. 14 is a view as in FIG. 13, showing the clip further pried out its mounting surface.
Figure 16:
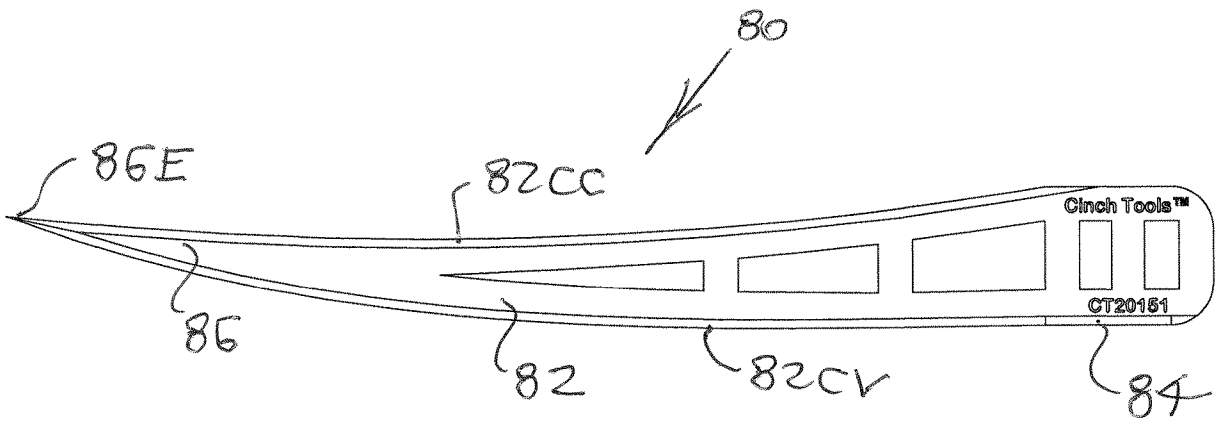
FIG. 16 is a side plan view of the persuader tool of FIG. 15.
Figure 15:
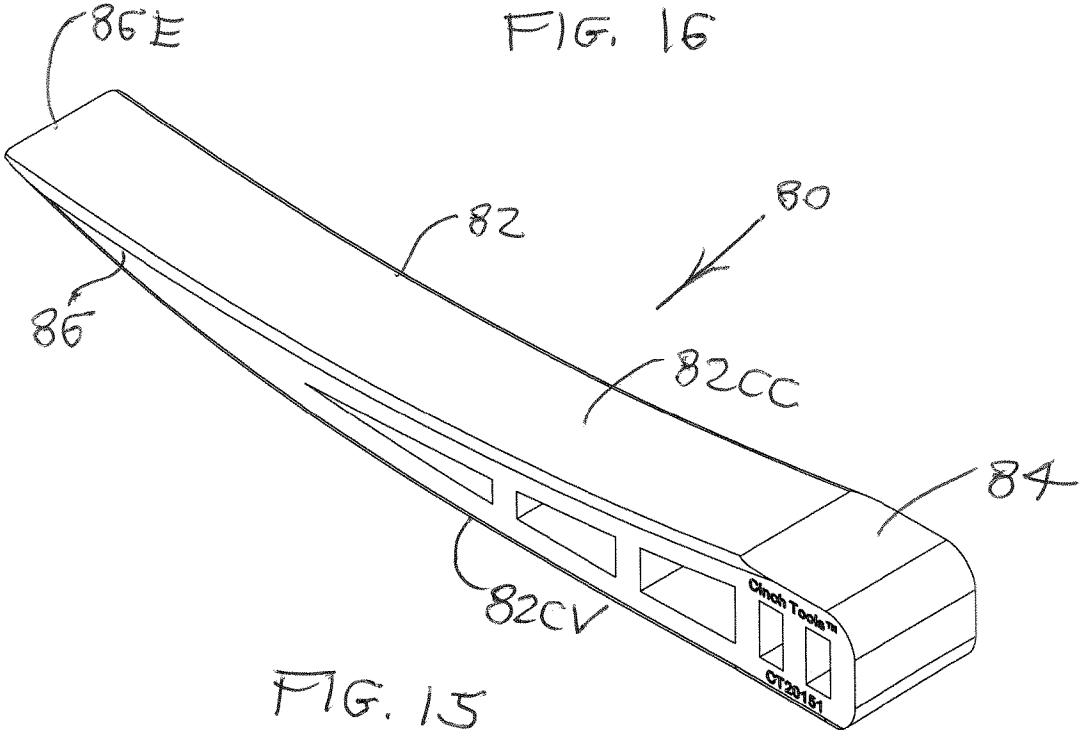
FIG. 15 is a perspective view of the persuader tool, showing its preferred full length curve.
Figure 17:
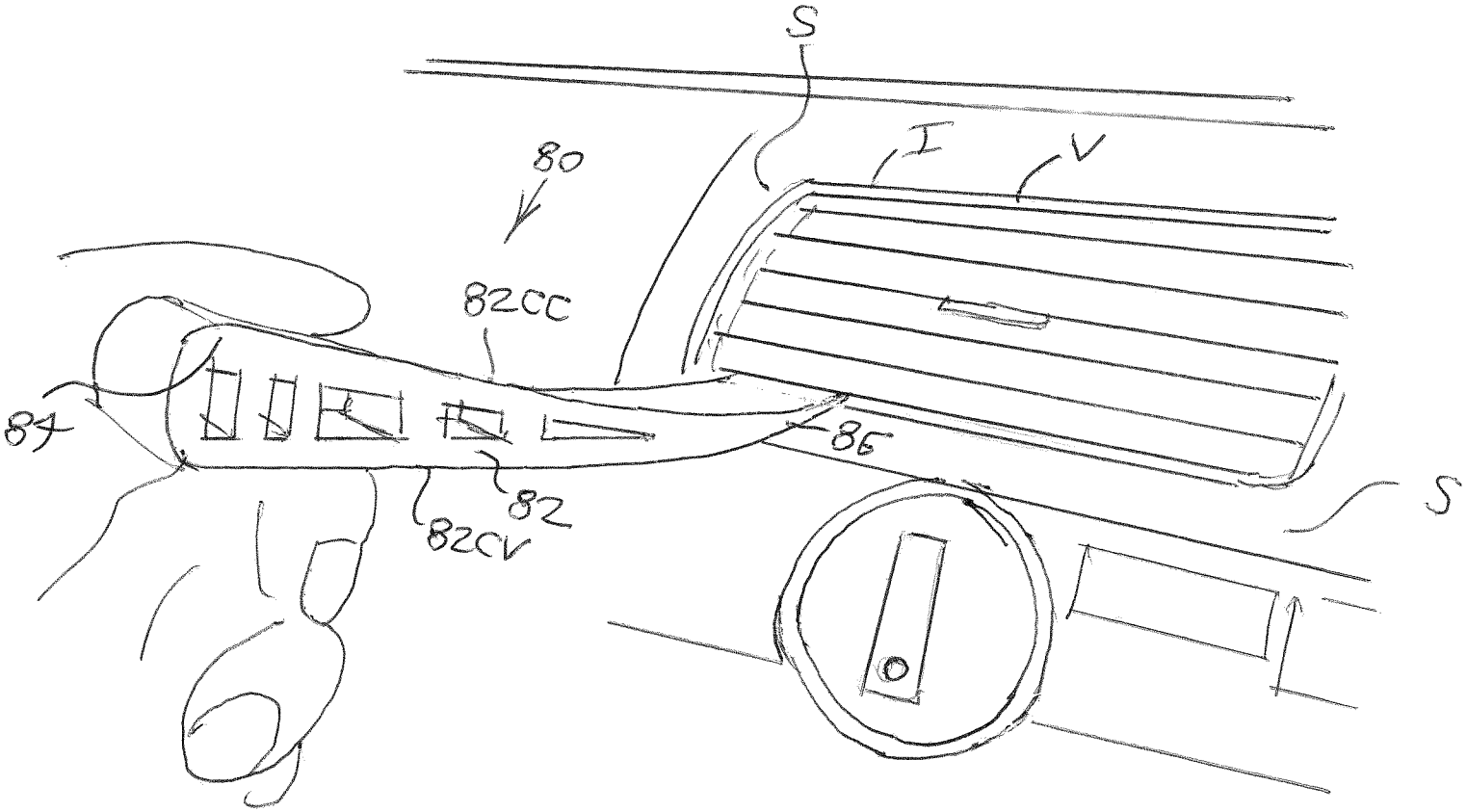
FIG. 17 is a perspective view of the persuader tool of FIG. 15, beginning to pry the vent out of an opening in a dash board mounting surface, with its convex surface oriented upward.
Figure 18:
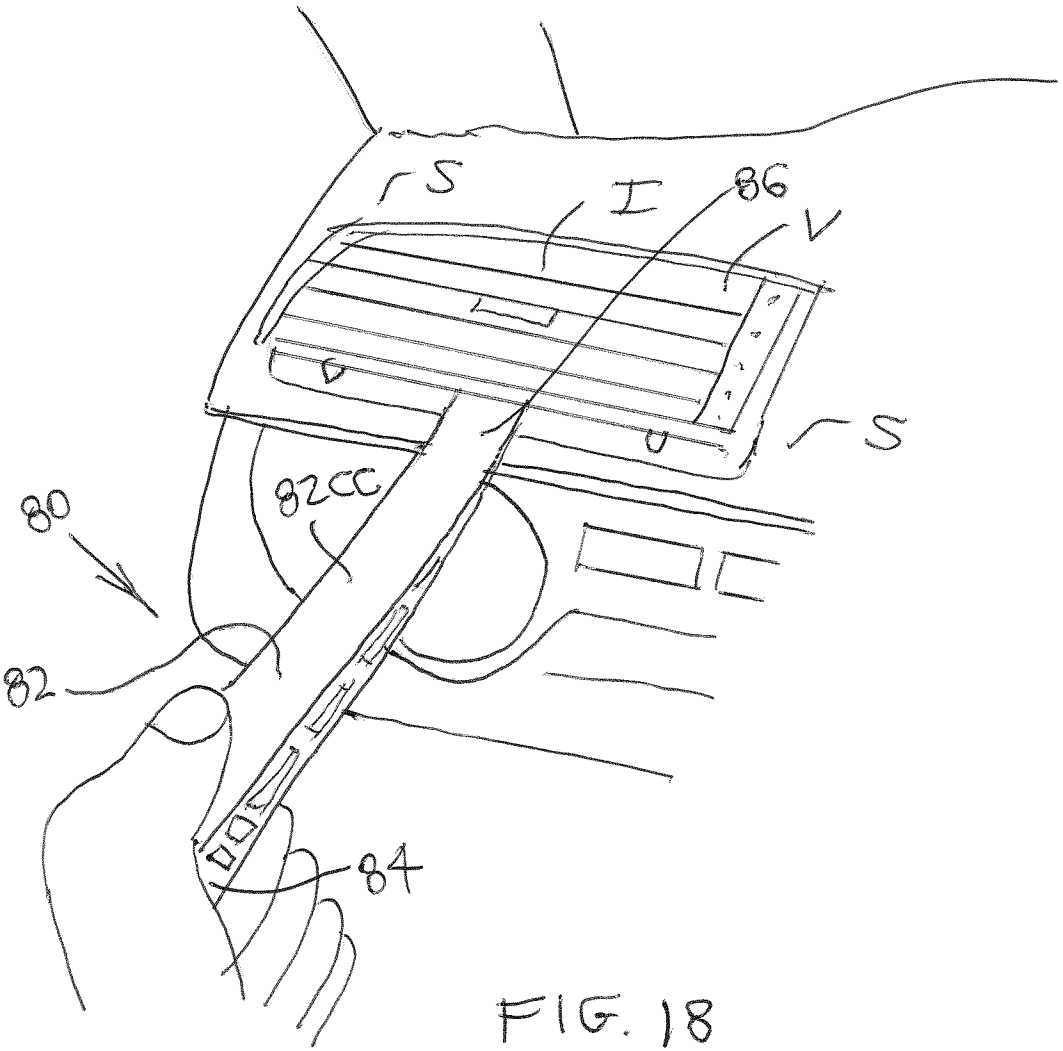
FIG. 18 is a view as in FIG. 17, showing the vent partly pried out the opening in the dashboard mounting surface.
Figure 19:
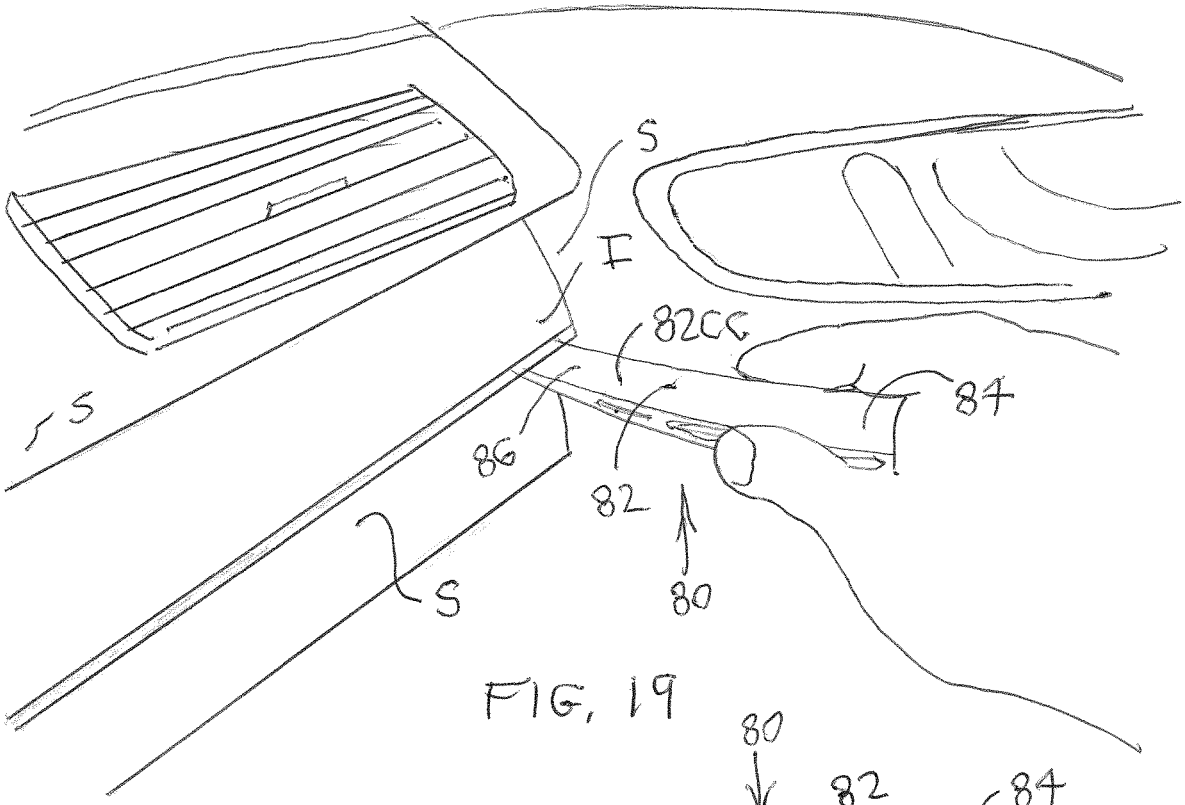
FIG. 19 is a perspective view of the persuader tool of FIG. 15 beginning to pry a trim item from a dashboard mounting surface, with its concave surface oriented upward.
Figure 20:
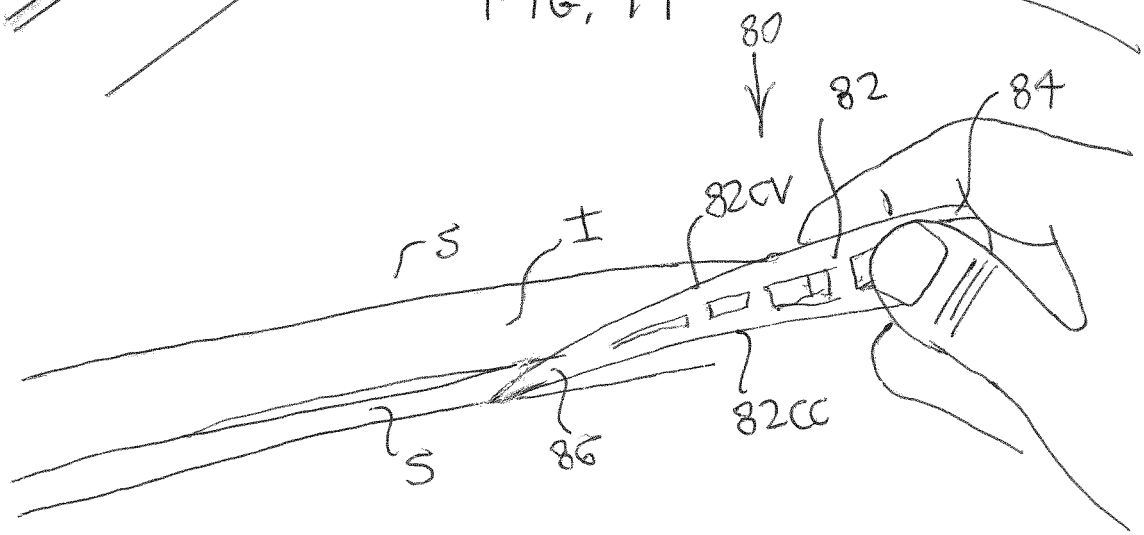
FIG. 20 is a perspective view of the persuader tool of FIG. 15, prying another trim item from a mounting surface, in this instance with its convex surface oriented upward, illustrating the adaptability of the persuader tool to various uses.
Figure 21:
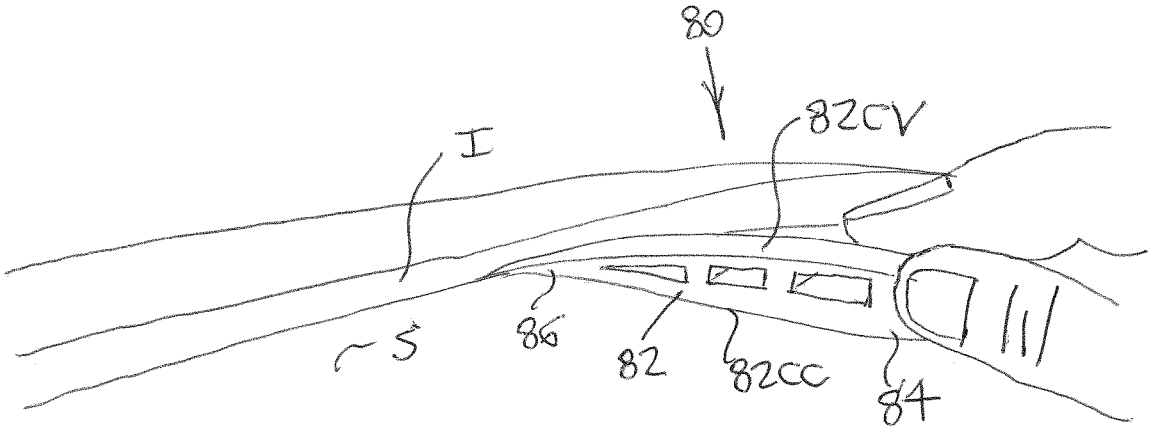
FIG. 21 is a perspective view of the persuader tool of FIG. 15 beginning to pry a still another item from a mounting surface with its concave surface upward.
Figure 22:
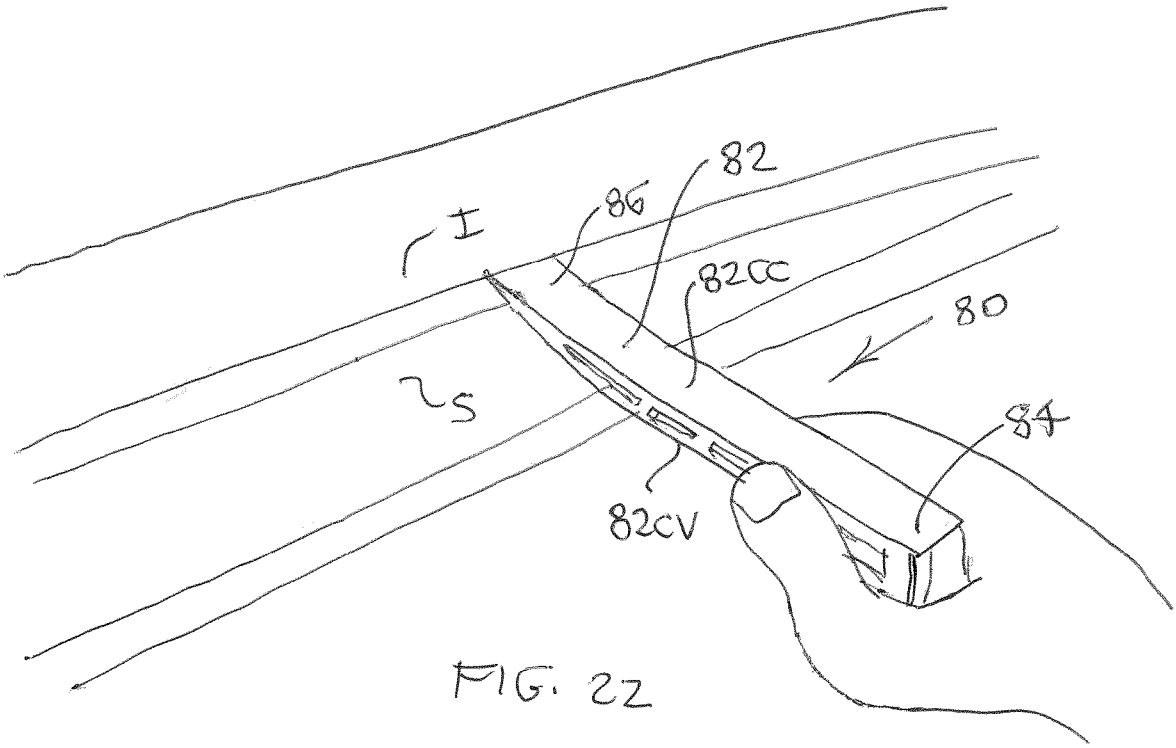
FIG. 22 is a perspective view of the persuader tool of FIG. 15, prying another trim item from a mounting surface, in this instance with its convex surface upward, again illustrating the adaptability of the persuader tool to various uses.
Figure 23:
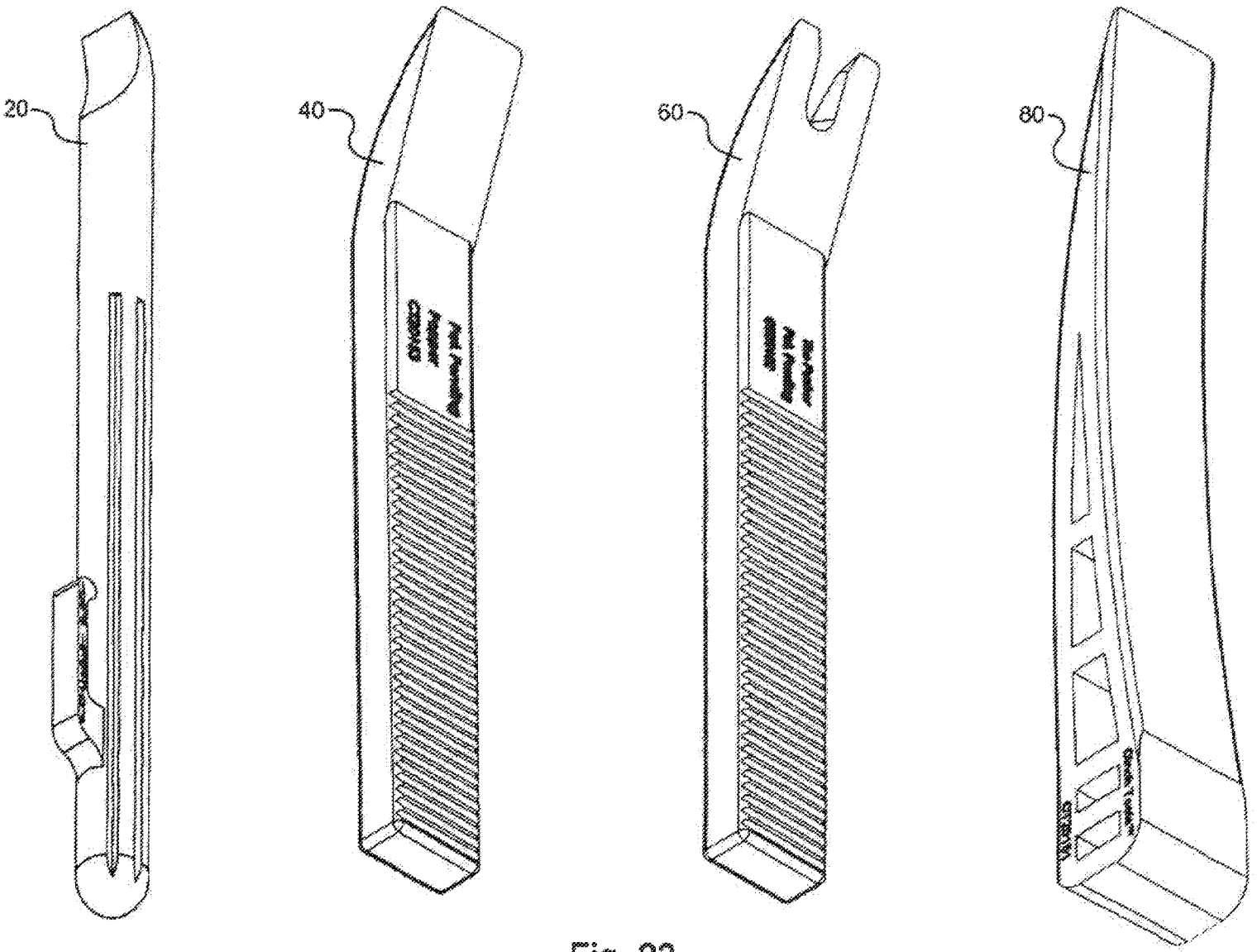
FIG. 23 is a plan view of the present tools shown together as a set.

Referring to FIGS. 1-22, a set of tools 100 of progressively increasing leverage for specialized prying functions is disclosed which perform all trim removal functions previously requiring a much larger set of trim tools. The set of tools 100 includes a sharp curve trim removal tool 20, a defined fulcrum trim and upholstery removal tool 40, a defined fulcrum clip removal tool 60, and a progressive curve trim and upholstery removal tool 80, all formed of a suitable non-metallic material and preferably of the high performance acetal resin known by the trade name DELRIN™. Acetal resin provides great strength with a slippery, low friction surface.

The sharp curve trim removal tool 20, also referred to as the POCKET PRY™, includes an elongate cylindrical rod 22 having a rounded proximal end 24 and a scalloped, scoop-shaped distal end 26. See FIGS. 1-5. The circumferential side surface of the rod 22 preferably has a grip enhancing texture 28, such as the illustrated parallel grooves. A pocket clip 30, similar to those fitted onto pencils, preferably is fitted over the rod 22 near the proximal end 24.

The defined fulcrum trim and upholstery removal tool 40, also referred to as the PUSHER™, is well suited to removing an item I such as a vent V from a hole in a dashboard and includes a flat bar 42, preferably of rectangular cross-section. See FIGS. 6-9. The bar 42 has a rectilinear handle segment 42H extending from the tool proximal end 44 to a middle segment 42M, and a curved tool distal end 46 defining a rounded corner functioning as an acute upturned fulcrum curve 42FC along a tool lower surface 42L. The angle at the distal end of the bar 42 acts as a fulcrum when removing items I, giving the user added mechanical advantage. The bar 42 has a flat upper engaging surface 42M, the fulcrum curve 42FC, tapering the distal end 46 to a sharp edge 46E and to generally define a wedge-shape. The linear handle segment 42H preferably has a grip enhancing texture 48, such as the illustrated lateral, parallel grooves.

The defined fulcrum clip removal tool 60, also referred to as the POPPER™, has the same structure as the defined fulcrum trim and upholstery removal tool 40, but with an additional structural feature. See FIGS. 10-14. This matching structure includes a flat bar 62, again preferably of rectangular cross-section. The bar 62 has a bar upper surface 66U and a bar lower surface 66L and a rectilinear handle segment 62H extending from the tool proximal end 64 to a middle segment 62M, and an arched tool distal end 66 defining a rounded corner in the form of an acute upturned fulcrum curve 62FC along the bar lower surface 62L. The bar 62 has a flat upper engaging surface 62M, the fulcrum curve 62FC, again tapering the distal end 66 to a sharp edge 66E and to generally define a wedge-shape, but a central notch 66N is provided in the edge 66E extending into the distal end 66. Once again, the angle at the distal end of the bar 62 acts as a fulcrum when removing items I, giving the user added mechanical advantage. The notch 66N permits engagement and popping of a clip CL such as a push clip securing interior panels in automobiles. The notch 68 receives the clip connecting structure CLC. The linear handle segment 62H preferably has a grip enhancing texture 68, such as the illustrated lateral, parallel grooves.

The progressive curve trim and upholstery removal tool 80, also referred to as the chinch tool or PERSUADER™, includes an elongate member 82 shaped as a wedge, where the wedge wider end is the tool proximal end 84 for gripping, and the wedge narrow end converging to a sharp edge 86E is the tool distal end 86 for insertion under or behind an item I to be removed.

See FIGS. 15-22. The wedge shaped elongate member 82 has a member upper surface 82U and a member lower surface 82L, and a progressive curve along its length, so that it has a wedge convex face 82CV and a wedge concave face 82CC. The progressive curve provides an infinite number of potential fulcrum points along the full length of the elongate member 82, permitting the tool 80 to be pivoted as a lever at any point along its convex face 82CV, giving the user added mechanical advantage for more effective prying. The wedge shape also permits the tool 80 to be pushed between the item I and the adjacent surface S to separate the item I from the surface S. The tool 80 may be used to remove plastic, wood, metal, or leather items I or parts that otherwise may be easily damaged during removal. The length and curve of the tool 80 permits the user to remove trim items I in hard to reach places, such as defrost vents V close to the windshield (not shown) of a vehicle. This tool 80 is especially useful when installing body seals, as the tool 80 can guide the lip of the seal along the vehicle body without damaging the body work or the seal.

These tools 20-80 have been designed with smooth finishes, which create less friction while fitting the given tool between tightly fit parts. The smooth finish also makes the tools 20-80 non-marring and easy to clean. Using clean tools is important as these some of these tools are predominantly used on interior trim and upholstery, which may be leather. The tools 20-80 preferably have a light color to permit the user to see dirt build up and consequently clean the tool as needed.

Method

In practicing the invention, the following method may be used. For any of the tools 20-80 in the set of tools 100, the sharp distal end is inserted between an edge of an item Ito be removed and the surface S to which it is secured. The given tool 20, 40, 60 or 80 can be pivoted to on a curved portion of its side, which acts as a fulcrum to provide a mechanical advantage for item I removal.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A set of tools, comprising:
a sharp curve trim removal tool;
a defined fulcrum trim and upholstery removal tool;
a defined fulcrum clip removal tool;
and a progressive curve trim and upholstery removal tool;
wherein said defined fulcrum trim and upholstery removal tool comprises a flat bar; and
wherein said tool has a tool proximal end and wherein said flat bar has a rectilinear handle segment extending from the tool proximal end to a middle segment, and a curved tool distal end defining a rounded corner functioning as an acute upturned fulcrum curve along a tool lower surface, such that the angle at the distal end of the bar acts as a fulcrum when removing items, giving the user added mechanical advantage.

2. The set of tools of claim 1, wherein said bar has a flat upper engaging surface, the fulcrum curve, tapering the distal end to a sharp edge and to generally define a wedge-shape.

3. The set of tools of claim 2, wherein said linear handle segment has a grip enhancing texture.

4. The set of tools of claim 3, wherein said trip enhancing texture comprises a plurality of lateral, parallel grooves.

5. A set of tools, comprising:
a sharp curve trim removal too
a defined fulcrum trim and upholstery removal tool;
a defined fulcrum clip removal tool;
and a progressive curve trim and upholstery removal tool;
wherein said defined fulcrum clip removal tool comprises a flat bar of rectangular cross-section, said bar having a bar upper surface and a bar lower surface and a rectilinear handle segment extending from the tool proximal end to a middle segment, and an arched tool distal end defining a rounded corner in the form of an acute upturned fulcrum curve along the bar lower surface; and
wherein said bar has a flat upper engaging surface, a fulcrum curve, tapering the distal end to a sharp edge to generally define a wedge-shape, and a central notch in the edge extending into the distal end
such that the use has an added mechanical advantage, said notch permits engagement and popping of a clip the notch receives the clip connecting structure.

6. The set of tools of claim 5, wherein said linear handle segment has a grip enhancing texture.

7. The set of tools of claim 6, wherein said grip enhancing texture comprises a plurality of lateral, parallel grooves.

* * * * *